United States Patent [19]

Mann

[11] Patent Number: 5,004,471

[45] Date of Patent: Apr. 2, 1991

[54] STERILE EAR PIERCING ASSEMBLY

[75] Inventor: Samuel J. Mann, Englewood, N.J.

[73] Assignee: Inverness Corporation, Fair Lawn, N.J.

[21] Appl. No.: 477,081

[22] Filed: Feb. 8, 1990

[51] Int. Cl.[5] ..... A61B 17/34; A44C 7/0

[52] U.S. Cl. ..... 606/188; 63/13

[58] Field of Search ..... 606/188, 185, 117; 227/67, 73; 63/1.1, 12, 13

[56] References Cited

U.S. PATENT DOCUMENTS

| | | | |
|---|---|---|---|
| 4,009,718 | 3/1977 | Hastings | 606/188 |
| 4,030,507 | 6/1977 | Mann | 606/188 |
| 4,079,740 | 3/1978 | Phalon | 606/188 |
| 4,191,190 | 3/1980 | Hastings | 606/188 |
| 4,527,563 | 7/1985 | Reil | 606/188 |
| 4,860,747 | 8/1989 | Sciara | 606/188 |
| 4,921,494 | 5/1990 | Neil | 606/188 |
| 4,931,060 | 6/1990 | Auéé606 | 188/ |

FOREIGN PATENT DOCUMENTS

| | | | |
|---|---|---|---|
| 2135171 | 8/1984 | United Kingdom | 606/188 |
| 2142538 | 1/1985 | United Kingdom | 606/188 |
| 2187960 | 9/1987 | United Kingdom | 63/13 |

*Primary Examiner*—C. Fred Rosenbaum
*Assistant Examiner*—William W. Lewis
*Attorney, Agent, or Firm*—Blum Kaplan

[57] ABSTRACT

An earlobe piercing assembly for maintaining a piercing earring sterile during handling, storage and piercing is provided. The assembly includes a piercing earring having an abstractly shaped enlarged head portion and a piercing pin extending therefrom and a cartridge uniquely configured to receive the piercing earring. The cartridge includes two clampings for securely supporting and positioning the piercing earring and a second rear portion including side walls and rear walls to substantially envelope said piercing earring. A cartridge housing receives and guides said cartridge, and permits said cartridge to be stored in a position which is substantially retained in the housing and is displaceable from the housing. This housing includes camming surfaces for engaging the clampings of the cartridge when the cartridge is partially displaced from the housing. The camming surfaces displace the clamping from the piercing earring so that the piercing earring is released from said cartridge.

12 Claims, 6 Drawing Sheets

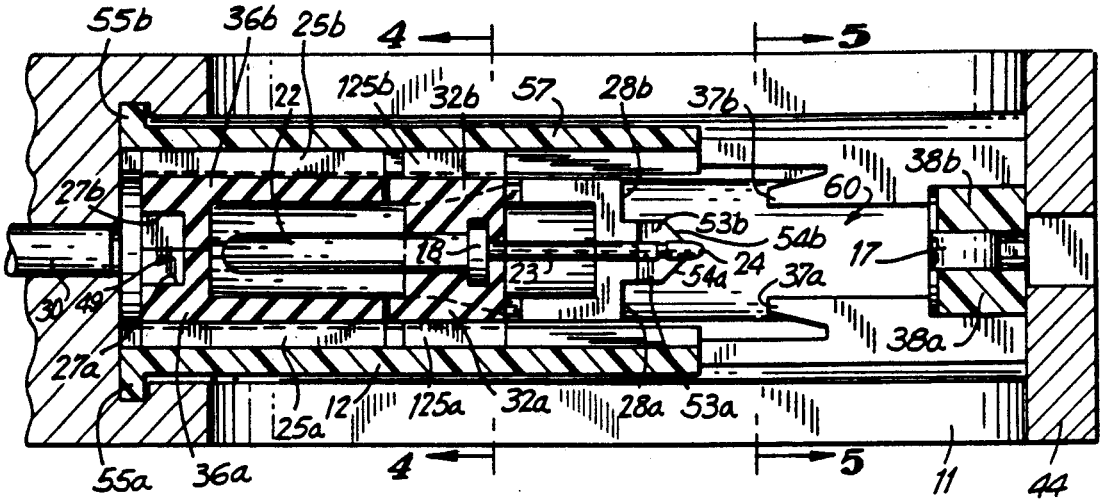
FIG. 3
FIG. 4
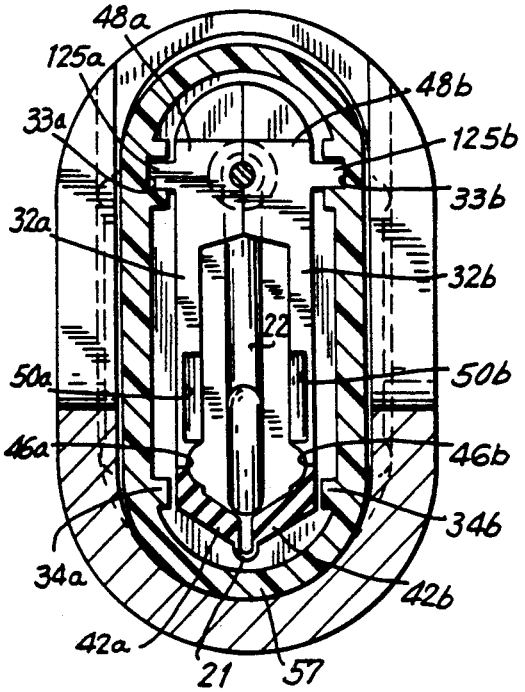
FIG. 5
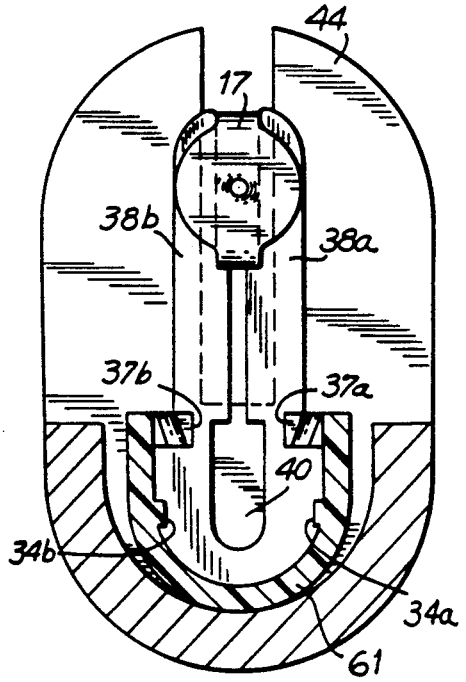

FIG. 6
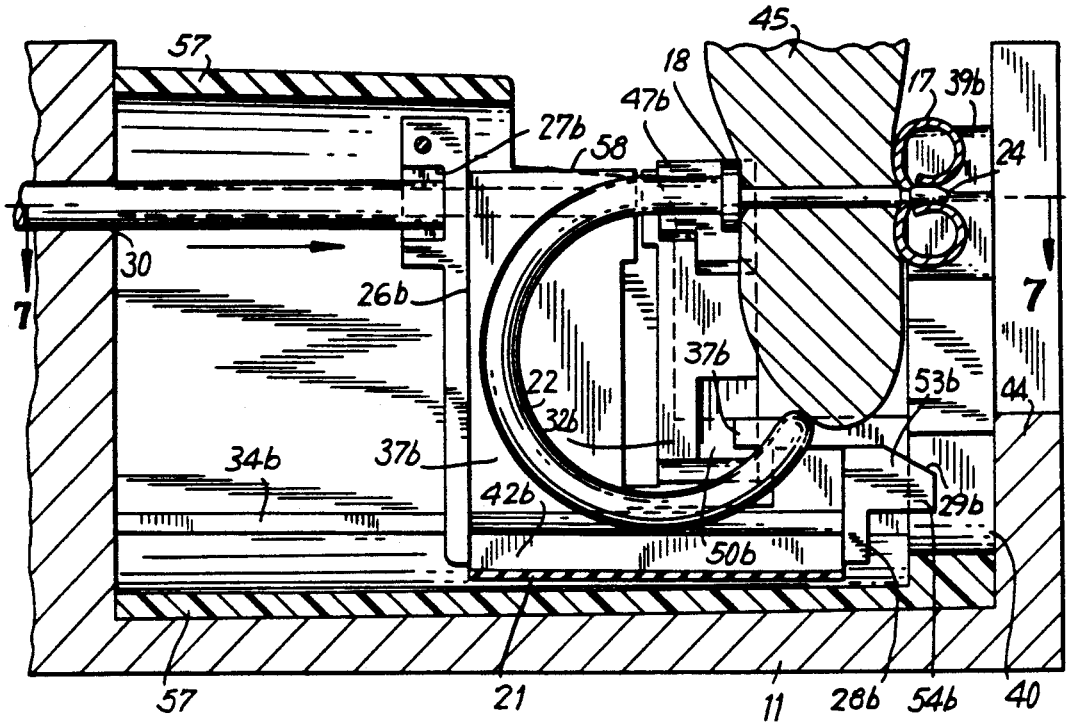
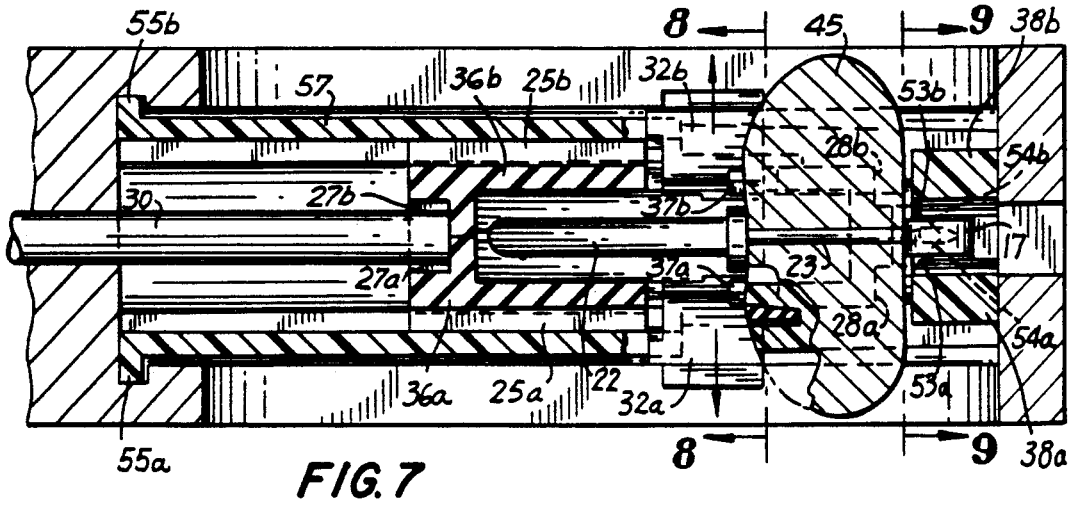
FIG. 7

STERILE EAR PIERCING ASSEMBLY

BACKGROUND OF THE INVENTION

This invention is directed to an earlobe piercing assembly for maintaining a piercing earring sterile during handling, storage and piercing. In particular, this invention is directed to an earlobe piercing assembly that permits an earlobe to be pierced by a variety of piercing earrings which have ornamental heads which are shaped to have a lateral dimension that is relatively narrow when compared to the height of the piercing earring.

Heretofore, numerous ear piercing systems have been developed that permit the piercing of an earlobe to provide a permanent opening in an earlobe for wearing a pierced earring. The earlobe piercing assemblies created by the present inventor disclosed in U.S. Pat. No. 4,030,507 enables an earlobe to be pierced by a piercing earring that remains sterile during shipping, storage and ear piercing.

The ear piercing system described and claimed in U.S. Pat. No. 4,030,507 is limited to piercing an ear with a piercing earring that is symmetrically shaped around the axis of the piercing pin. However, it is desirable to market ear piercing earrings as fashion accessories. For example, earrings in the shape of a hoop, earrings that have a tassel, or earrings that have a dimension of relatively narrow width when compared to the height of the earring are well known in the art. Moreover, since for medical reasons the earring which pierces the ear usually must remain in the earlobe for several weeks, it is desired to permit the piercing of an earlobe with an earring that admits of an abstract design. Accordingly, an ear piercing system that obtains each of the advantages of the system described and claimed in U.S. with a piercing earring having an ornamental design that includes a lateral dimension that is narrow when compared to the height thereof is provided.

Still another object of the invention is to provide an improved earlobe piercing assembly wherein an irregularly shaped piercing earring and earring clutch are maintained sterile during packaging, handling and earlobe piercing.

Still a further object of the instant invention is to provide an improved earlobe piercing assembly wherein all elements are maintained sterile and an abstractly shaped ornamental earring head attached to a piercing pin may be the initial earring used in the piercing process.

Yet another object of the instant invention is to provide an improved earlobe piercing assembly wherein the piercing earring is securely guided to and accurately aligned with the desired location on the earlobe during the entire piercing procedure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a sectional view taken along line 3—3 of FIG. 2;

FIG. 4 is a sectional view taken along line 4—4 of FIG. 3;

FIG. 5 is a sectional view taken along 5—5 of FIG. 3;

FIG. 6 is a partial sectional view taken along line 2—2 of FIG. 1, and displaying the cartridge i its fully displaced position;

FIG. 7 is a partial sectional view taken along line 7—7 of FIG. 6;

DETAILED DESCRIPTION OF THE PREFERRED EMBODIMENTS

FIGS. 1-12 illustrate a sterile ear piercing assembly, generally indicated at 10, constructed in accordance with the invention. In particular, ear piercing assembly 10 includes an ear piercing plunger assembly 11, which is fully disclosed in U.S. Pat. No. 4,030,507, which patent is incorporated by reference herein, as if fully set forth herein.

Figure 10:
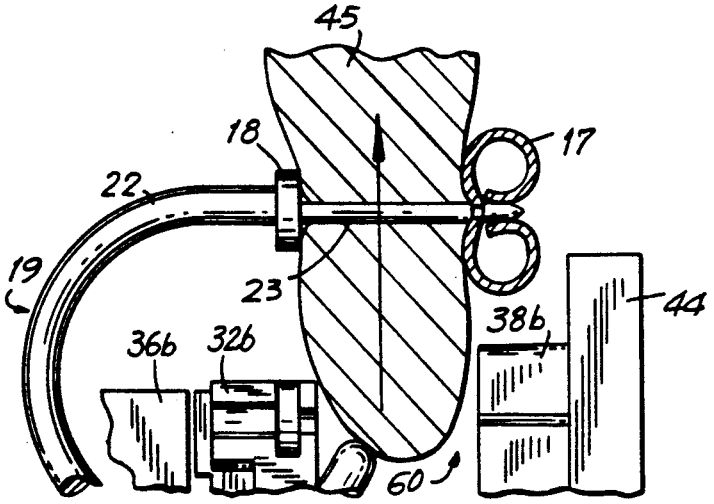
FIG. 10 is a sectional view of the ear with piercing earring attached to clutch after the piercing operation is complete.

A cartridge housing, generally indicated as 12, is adapted to be slideably secured in plunger assembly 11 and supports therein an earring cartridge, generally indicated as 13. A piercing earring 19 is disposed in earring cartridge 13. Earring 19 includes an enlarged ornamental hoop 22 and projection ring 18 with a piercing pin 23 projecting therefrom and terminating at a sharp point 24. By way of reference herein, the piercing pin projects in the "axial" direction. Ornamental hoop 22 includes a "height" which is defined by the distance of the "C-shape" parallel to the earlobe. The term "lateral" as used herein refers to the direction perpendicular to the "axial" direction and the "height" as previously defined. Asymmetrical about the axis of piercing pin 23, piercing pin 19 exemplifies the type of piercing earring which may be used in the invention and has a lateral dimension that is relatively narrow compared to the height thereof. An earring clutch 17 is provided which secures piercing earring 19 to earlobe 45 after the piercing process is completed, as depicted in FIG. 10.

Reference is specifically made to FIGS. 1-5, 11 and 12 wherein earring cartridge 13 formed of two half walls 20a and 20b connected by a hinge 21 is depicted. Half wall 20a is symmetrical with half wall 20b and accordingly the following description with respect to half wall 20a is identical with respect to half wall 20b and each element referred to herein with the lower case letter suffix "a" has a counterpart with the same number and the suffix "b". By way of orientation and to simplify the description of the half wall 20a, the length thereof is defined herein as being along the axial direction defined by the displacement of plunger 30 of plunger assembly 11.

Half wall 20a includes a shoulder 42a supporting an upright support wall 36a at the rear end of the cartridge, a upright retaining clamping arm 32a in the mid-portion of the cartridge and a shortened upright camming wall 41a at the front end of the cartridge. Upright support wall 36a includes a rear wall 26a. When half walls 20a and 20b are folded together, rear walls 26a and 26b and support walls 36a and 36b define a cavity for receiving therein a portion of ornamental hoop 22.

A flange 25a projects from support wall 36a along the axial length thereof. Rear walls 26a and 26b when secured together, include opposed C-shaped recess walls 27a and 27b, respectively, which walls when secured together define a square-shaped receiving well 49 for receiving plunger 30 during the ear piercing operation.

Upright retaining clamping arm 32a includes at the upper portion thereof flange 125a which flange is disposed along the axial length of clamping arm 32a and is in axial registry with flange 25a. Clamping arm 32a is secured to shoulder 42a by a cutaway flexure joint 46a which defines a living hinge that permits the clamping arm 32a to be bent during the ear piercing operation in a manner to be discussed in detail below.

On the interior of clamping arm 32a is an inclined camming ramp 50a which gradually tapers toward the outer surface of clamping arm 32a as it extends to the front of earring cartridge 13. At the top of clamping arm 32a is a retaining head 48a, which retaining head projects inwardly and defines a clamping surface 47a. Clamping surface 47a includes an axially-oriented indentation 51a and a vertically-oriented indentation 52a. Accordingly, when clamping arms 32a and 32b are folded together, clamping surfaces 47a and 47b will secure therebetween a portion of ornamental hoop 22 and a portion of piercing pin 23, which are captured in axially-oriented indentations 51a and 51b and projection ring 18 which is captured in vertically-oriented indentations 52a and 52b. As will be explained in greater detail below, when earring cartridge 13 is received in cartridge housing 12, clamping surfaces 47a and 47b of retaining heads 48a and 48b are brought together to retain and secure piercing earring 19 in earring cartridge 13.

Shortened upright camming wall 41a includes a front wall 28a which supports an axially-projecting camming finger 53a. Camming finger 53a includes a wedge 29a which has an inclined camming surface 54a that tapers from the outer surface inwardly as it extends to the front of earring cartridge 13. As will be explained in greater detail below, camming finger 53a is utilized to affect a release of clutch 17 from ear piercing assembly 10 at the completion of the piercing of earlobe 45.

Cartridge housing 12 includes an ovally-shaped tubular housing wall 57 which extends from the rear of the housing to approximately the mid-point thereof. A cutaway portion 58 permits access to the interior of cartridge housing 12. Vertically-orienting lateral flanges 55a and 55b are supported by housing wall 57 and are utilized to releasably secure cartridge housing 12 in plunger assembly 11. Opposed facing tracks 33a and 33b are supported on the interior of housing wall 57 and are adapted to receive therein flanges 25a, 25b 125a and 125b of earring cartridge 13 to provide stability and accurate alignment. Opposed facing axially-extending positioning ribs 34a and 34b are supported in housing wall 57. Positioning ribs 34a and 34b support earring cartridge 13 and provide a fulcrum for the living hinges formed by cutaway flexure joints 46a and 46b in clamping arm 32a and 32b of earring cartridge 13.

A second cutaway region illustrated at 60 is provided in housing 12 in order to permit earlobe 45 to be received in cartridge housing 12. Clamping arm camming fingers 37a and 37b are formed in a U-shaped section 61 of cartridge housing 12 underneath cutaway region 60. Camming fingers 37a and 37b are constructed and arranged to engage camming ramps 50a and 50b respectively, when earring cartridge 13 is axially displaced into engagement with camming fingers 37a and 37b.

At the front of cartridge housing 12 are uprights 38a and 38b. Uprights 38a and 38b are spaced apart and each include a clutch-receiving recess 39a and 39b respectively. Uprights 38a and 38b are spaced apart a sufficient distance to allow clutch 17 to be received and frictionally retained in recesses 39a and 39b. A camming opening 40 is defined between uprights 38a and 38b for receiving camming fingers 53a and 53b when earring cartridge 13 is fully displaced and the piercing of earlobe 45 is being completed.

Figure 11:
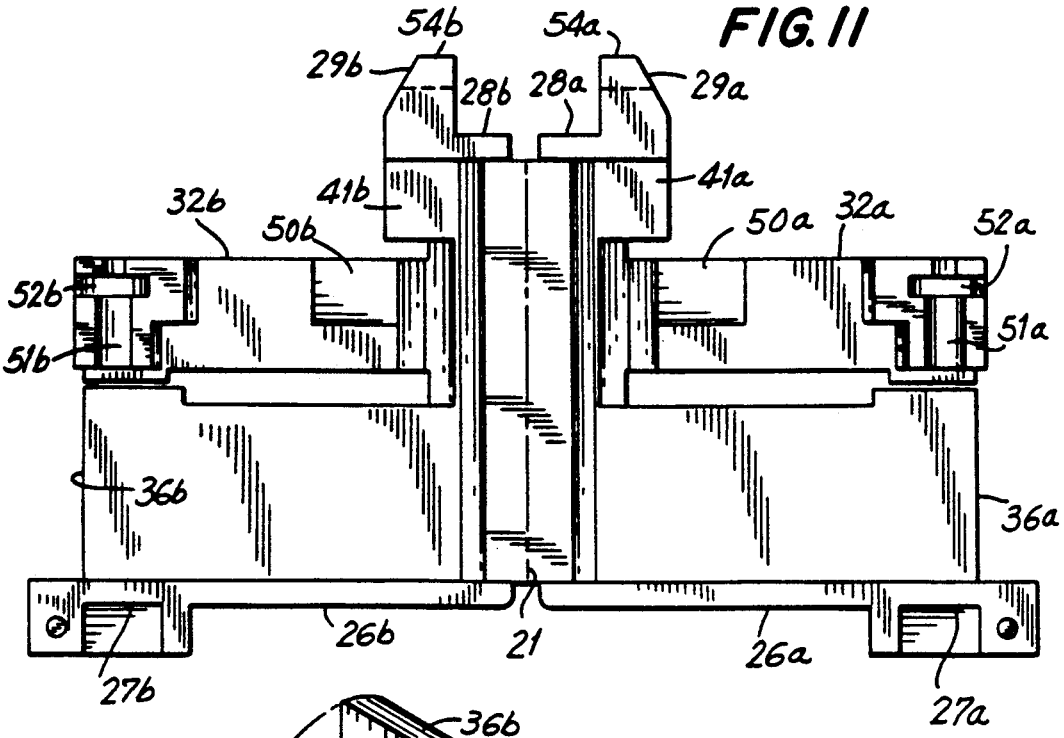
FIG. 11 is a top plan view of the cartridge when fully opened.
Figure 12:
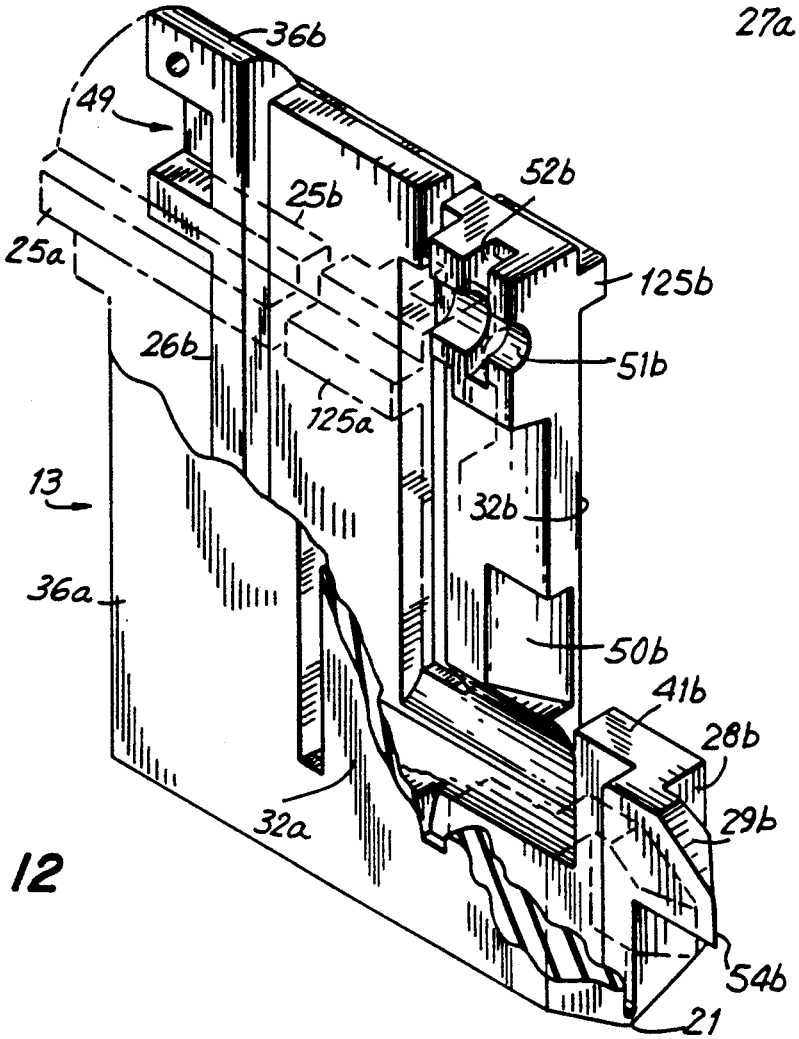
FIG. 12 is a broken away perspective view of the cartridge when folded.

During assembly, earring 19 is placed in the unfolded earring cartridge 13 shown in FIG. 11. Earring cartridge 13 is folded along hinge 21 so that piercing earring 19 is retained by clamping are 32a and 32b. Projection ring 18, a portion of piercing pin 23 and a portion of ornamental hoop 22 are retained in vertical indentations 52a and 52b and axial indentations 51a and 51b. When flanges 25a, 125a, 25b and 125b are introduced into tracks 33a and 33b of cartridge housing 12, clamping arms 32a and 32b are forced together, thereby preventing movement of piercing earring 19 in earring cartridge 13. Earring cartridge 13 is then positioned at the rear of cartridge housing 12.

In commercial use, after the assembly of piercing earring 19, earring cartridge 13 and cartridge housing 12, the entire assembly will be packaged to be ready for use at a later time. By way of example, the package which is provided for the assembled cartridge housing and clutch cartridge can be sealed by gas pervious tape, whereafter the sterilized gas is introduced into the package to thereby sterilize the piercing earring and clutch and insure that same are maintained sterile during storage, handling and piercing.

Prior to the piercing process, cartridge housing 12 is slideably displaced into plunger assembly 11. Vertically-oriented lateral flanges 55a and 55b of cartridge housing 12 are adapted to be slidably secured into retaining recesses 14a and 14b of plunger assembly 11. Plunger assembly 11 includes an actuator 43, an earlobe supporting wall 44, and a plunger 30.

The operation of the earlobe piercing assembly is as follows. Ear piercing assembly 10 is positioned such that earlobe 45 rests in cutaway region 60 of cartridge housing 12. Thereafter actuator 43 of plunger assembly 11 is lightly squeezed to advance plunger 30 in the direction of the arrow indicated in FIG. 2 from a rest position to a first partially displaced position. Displacement of plunger 30 to the first displaced position causes the plunger to engage square-shaped receiving well 49 defined by C-shaped recess walls 27*a* and 27*b*. This engagement results in the displacement of earring cartridge 13 from a rest position to the first partially displaced position shown in FIG. 2 wherein piercing earring 19 is projected to a position that is almost in contact with earlobe 45.

Reference is next made to FIGS. 6–9 which depicts piercing earring 19 entirely piercing through earlobe 45 before ear piercing assembly 10 is withdrawn. Plunger 30 engages square-shaped receiving well 49 defined by C-shaped recess walls 27*a* and 27*b* and displaces earring cartridge 13 substantially outside cartridge housing 12. Earring clutch 17 engages piercing pin 23.

Figure 1:
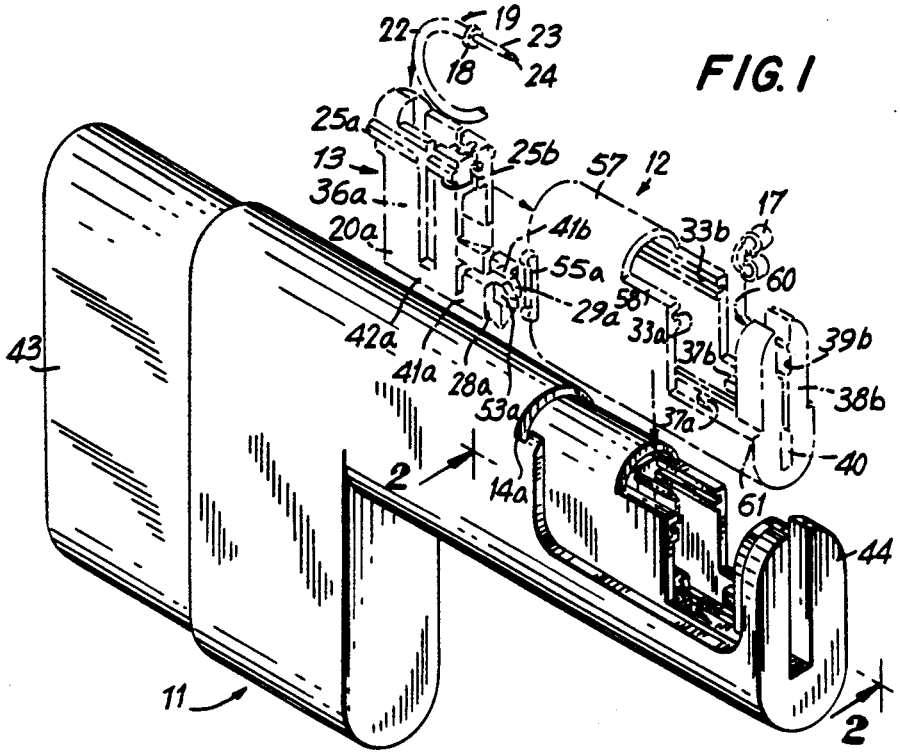
FIG. 1 is a perspective view of a sterile earlobe piercing assembly, including a phantom exploded illustration, constructed in accordance with a preferred embodiment of the instant invention.
Figure 2:
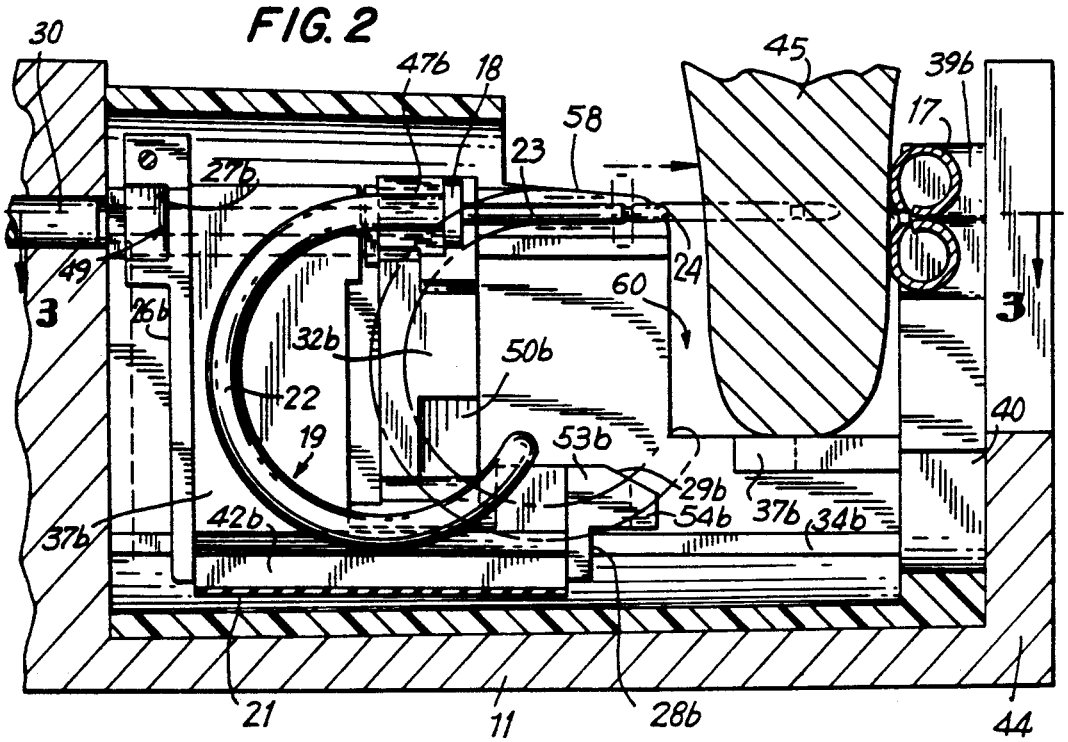
FIG. 2 is a partial sectional view of the cartridge and housing taken along line 2—2 of FIG. 1.
Figure 8:
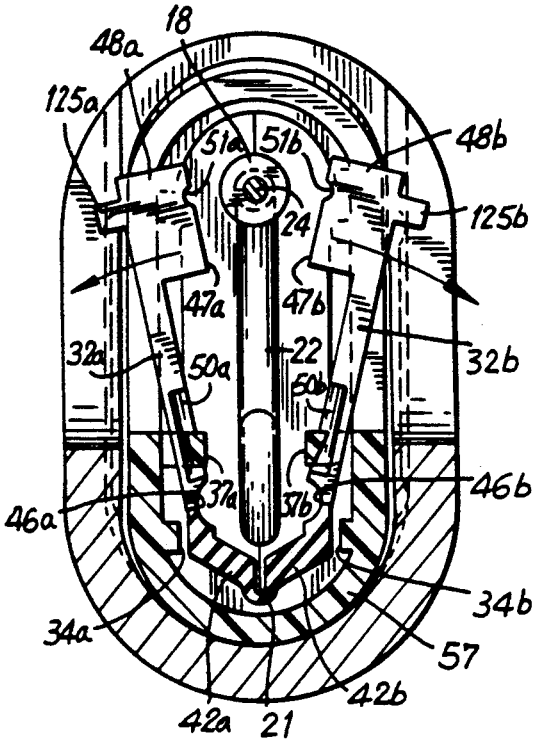
FIG. 8 is a partial sectional view taken along line 8—8 of FIG. 7.

Referring specifically to FIGS. 7 and 8, clamping arm camming fingers 37*a* and 37*b* engage camming ramps 50*a* and 50*b* thereby forcing clamping arms 32*a* and 32*b* to laterally open at the living hinges formed from cutaway flexure joints 46*a* and 46*b*. This movement releases piercing earring 19 from ear piercing assembly 10 after piercing pin 23 extends through earlobe 45 and is engaged by earring clutch 17.

Figure 9:
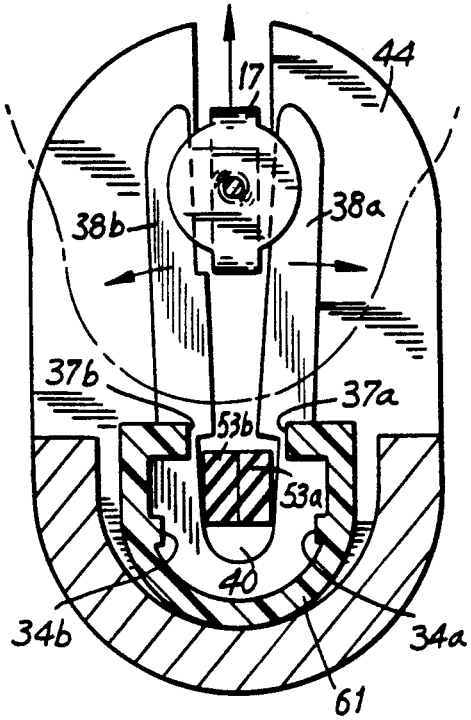
FIG. 9 is a partial sectional view taken along line 9—9 of FIG. 7.

Referring specifically to FIG. 9, wedges 29*a* and 29*b* of camming fingers 53*a* and 53*b* enter clamping opening 40 and wedge apart uprights 38*a* and 38*b* in the direction of the arrows. This action forces clutch receiving recess 39 to laterally expand, thereby releasing earring clutch 17 from uprights 38*a* and 38*b*.

Reference is next made to FIG. 10, wherein the final phase is shown according to the invention. Piercing earring 19 extends through earlobe 45 and is engaged by earring clutch 17. The remaining ear piercing assembly 10 has been partially retracted from earlobe 45.

The piercing assembly is designed to be used with the plunger propelling assembly described in U.S. Pat. No. 4,030,507 which is reusable with each new sterilely-packed earring cartridge and cartridge housing. Thus, the piercing earring is utilized as a training or permanent earring and is worn until the hole in the earlobe conforms, whereafter other pierced earrings can then be inserted therein.

Figure 13:
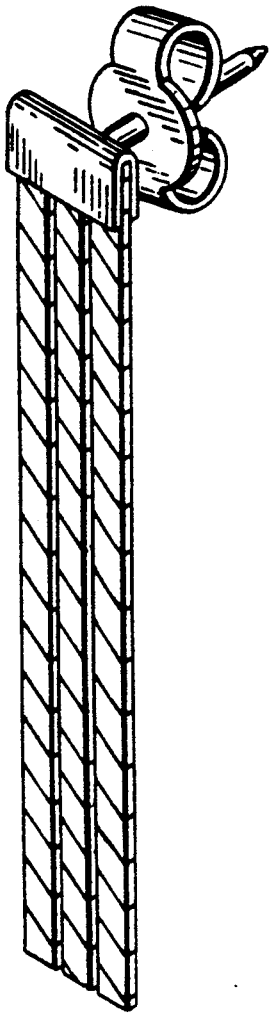
FIG. 13 is a perspective view of an earring that may be used in accordance with the invention.
Figure 14:
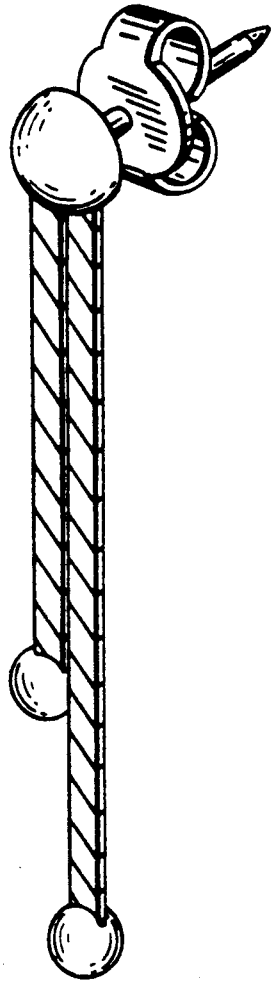
FIG. 14 is a perspective view of another earring that may be used in accordance with the invention.

It is further noted that among the benefits which ensure to the instant invention is the ability to use a jewelers earring having an abstractly shaped head attached to the piercing pin wherein the lateral dimension or width thereof is no narrower than the height thereof. Other examples of earrings which are adapted to be used with the ear piercing assembly of the instant invention are depicted in FIGS. 13 and 14.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ear piercing assembly comprising in combination:

an abstractly-shaped piercing earring including a piercing pin and an ornamental head which is asymmetrically oriented around the axis of the piercing pin and from which the piercing pin projects;

a cartridge adapted to receive said piercing earring and substantially envelope said piercing earring, said cartridge including clamping means for supporting and positioning said piercing earring in said cartridge; and a housing means for receiving and guiding said cartridge and permitting said cartridge to be stored in a position which is substantially retained in said housing and is displaceable from said housing, said housing including camming means for engaging said clamping means when said cartridge is partially displaced from said housing and displacing said clamping means from said piercing earring so that said piercing earring is released from said cartridge as the piercing is completed.

2. The ear piercing assembly of claim 1, wherein said housing means includes at least one chamber having a first opening for inserting said cartridge, and a second opening to allow the piercing earring to contact an earlobe.

3. The ear piercing assembly of claim 2, wherein said cartridge means is adapted to be particularly displaced in said housing means.

4. The ear piercing assembly of claim 1, and including a clutch adapted to be secured onto the piercing earring, wherein the housing means includes a clutch positioning means whereby the clutch is releasably secured in a location such that the piercing earring is secured onto the piercing earring after the piercing earring pierces the earlobe.

5. The ear piercing assembly of claim 4, wherein the cartridge has wedging means for engaging the clutch positioning means when the cartridge is partially displaced from the housing means and for displacing the clutch positioning means from the clutch so that the clutch is released from the clutch positioning means as the piercing earring pierces the earlobe and is secured by the clutch.

6. The ear piercing assembly of claim 5, wherein the clutch positioning means includes two uprights which together form both a clutch receiving recess for releasably securing the clutch and a clamping opening beneath the clutch receiving recess, and wherein the wedging means is two wedges which, when the cartridge is displaced, enter the clamping opening and force apart the two uprights, thereby releasing the clutch from the clutch receiving recess.

7. The ear piercing assembly of claim 1, wherein the piercing earring includes vertical projections between the ornamental head and the piercing pin, and the clamping means includes both a vertically-oriented indentation corresponding to the vertical projections and an axially-oriented indentation corresponding to the sections of the ornamental head and piercing pin held by the clamping means, thereby positioning and securing the piercing earring in the cartridge.

8. The ear piercing assembly of claim 1, wherein said clamping means includes a pair of opposed clamping arms, each arm including a living hinge attaching the arm to the cartridge, a shaft portion with a camming ramp located on a segment thereof, and an earring clamping surface for releasably securing the piercing earring in conjunction with the opposed earring clamping surface of the opposed clamping arm.

9. The ear piercing assembly of claim 8, wherein said camming means includes a pair of camming fingers which engage each of the camming ramps when the cartridge is partially displaced from the housing, thereby forcing the clamping arms to laterally open at the living hinges so that the piercing earring is released from the clamping surfaces after the cartridge is partially displaced from the housing means.

10. The ear piercing assembly of claim 1, wherein the ornamental head of the piercing earring has a lateral dimension which is relatively narrow compared to the height.

11. An ear piercing assembly comprising in combination:

a piercing earring including a piercing pin and an ornamental head from which the piercing pin projects;

a clutch adapted to be secured onto the piercing earring;

a cartridge adapted to receive said piercing earring and substantially envelop said piercing earring, said cartridge including wedging means; and a housing means for receiving and guiding said cartridge and permitting said cartridge to be stored in a position which is substantially retained in said housing and is displacable from said housing, said housing means including a clutch positioning means for releasably securing the clutch, said clutch positioning means engagable by the wedging means when the cartridge is partially displaced from the housing means and thereby displacing the clutch positioning means from the clutch so that the clutch is released from the clutch positioning means as the piercing earring pierces the earlobe and so that the clutch is secured onto the piercing earring after the piercing earring pierces the earlobe.

12. The ear piercing assembly of claim 11, wherein the clutch positioning means includes two uprights which together form both a clutch receiving recess for releasably securing the clutch and a clamping opening beneath the clutch receiving recess, and wherein the wedging means is two wedges which, when the cartridge is displaced, enter the clamping opening and force apart the two uprights, thereby releasing the clutch from the clutch receiving recess.

* * * * *

UNITED STATES PATENT AND TRADEMARK OFFICE

CERTIFICATE OF CORRECTION

PATENT NO. : 5,004,471

DATED : April 2, 1991

INVENTOR(S) : SAMUEL J. MANN

It is certified that error appears in the above-identified patent and that said Letters Patent is hereby corrected as shown below:

Column 1, line 39, delete "claimed in U.S.".

Signed and Sealed this

Twenty-fifth Day of August, 1992

*Attest:*

DOUGLAS B. COMER

*Attesting Officer*

*Acting Commissioner of Patents and Trademarks*